United States Patent [19]

Sommer et al.

[11] 4,401,397

[45] Aug. 30, 1983

[54] METHOD AND DEVICE FOR INSTALLING A SHAFT LINING IN SHAFTS THROUGH AN AQUIFEROUS FORMATION

[75] Inventors: Albrecht Sommer, Mülheim-Ruhr; Heinrich Sparenberg, Bottrop, both of Fed. Rep. of Germany

[73] Assignee: Gewerkschaft Walter, Fed. Rep. of Germany

[21] Appl. No.: 253,555

[22] Filed: Apr. 13, 1981

[30] Foreign Application Priority Data

Apr. 11, 1980 [DE] Fed. Rep. of Germany ..... 3014027

[51] Int. Cl.[3] ..... E21D 5/00; E21D 11/00

[52] U.S. Cl. ..... 405/133; 405/138

[58] Field of Search ..... 405/133, 146, 272, 138; 166/285, 338, 341, 349

[56] References Cited

U.S. PATENT DOCUMENTS

| | | | |
|---|---|---|---|
| 1,003,140 | 9/1911 | Lardy | 405/133 |
| 1,008,727 | 11/1911 | McCarthy | 405/133 |
| 3,250,076 | 5/1966 | Jenkins et al. | 405/133 |
| 4,083,405 | 4/1978 | Shirley | 166/285 |
| 4,178,110 | 12/1979 | Cobbs | 405/133 |

FOREIGN PATENT DOCUMENTS

| | | | |
|---|---|---|---|
| 1119802 | 12/1961 | Fed. Rep. of Germany | 405/133 |
| 670729 | 6/1979 | U.S.S.R. | 405/133 |

*Primary Examiner*—David H. Corbin
*Assistant Examiner*—Nancy J. Pistel
*Attorney, Agent, or Firm*—McGlew and Tuttle

[57] ABSTRACT

A method and device for lining a bore shaft extending through an aquiferous formation comprises, lowering a base ring on guide and alignment columns into the bore until the base ring is seated on a shoulder near the bottom of the bore which is at or below the lower end of the aquiferous formation. The base ring with connected columns are then centered in the bore. A plurality of lining rings are then sequentially lowered in a guided and aligned fashion on the column to rest on the base ring and on each other and to form sealing joints therebetween. The space between the thus formed lining and the bore can then be filled with filler material.

10 Claims, 8 Drawing Figures

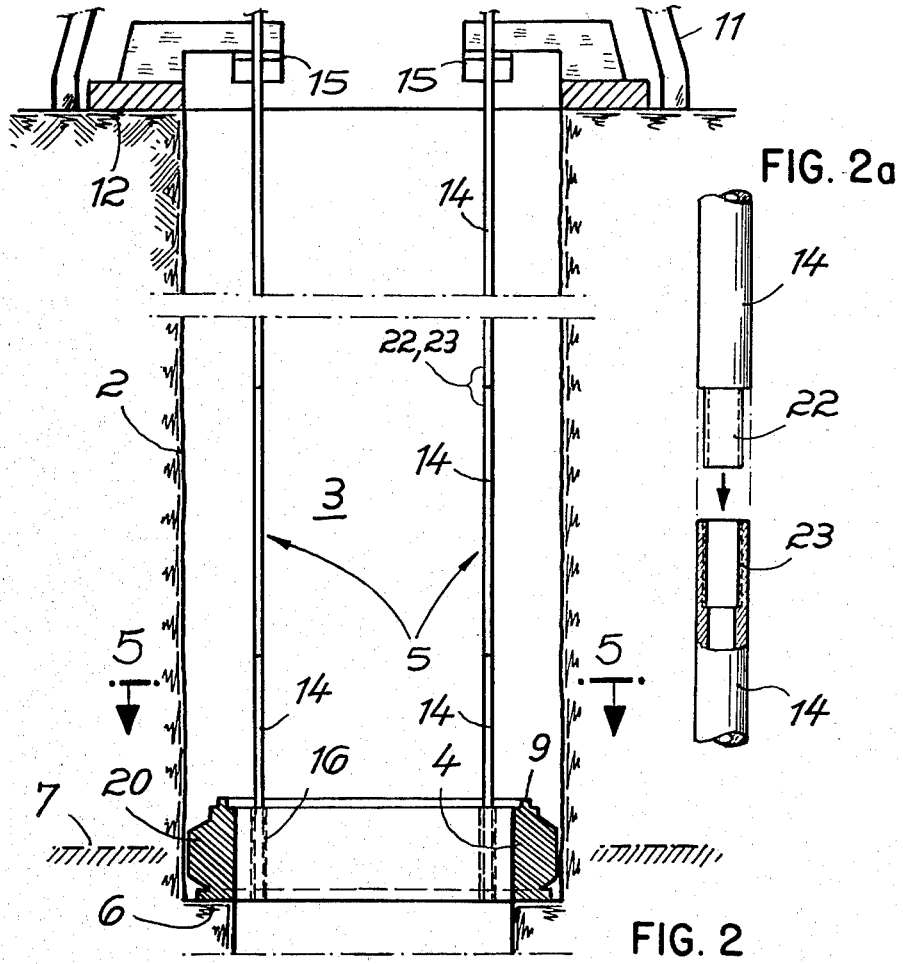
FIG. 2
FIG. 2a
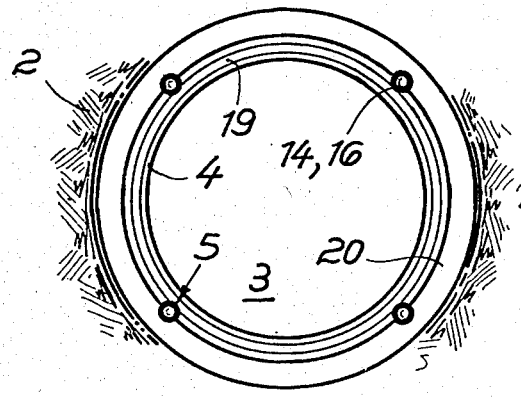
FIG. 5
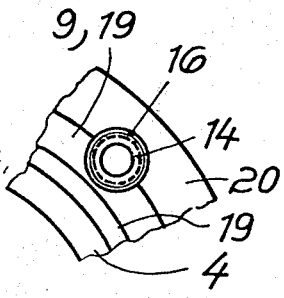
FIG. 5a

METHOD AND DEVICE FOR INSTALLING A SHAFT LINING IN SHAFTS THROUGH AN AQUIFEROUS FORMATION

FIELD AND BACKGROUND OF THE INVENTION

The present invention relates in general to shaft linings and in particular to a new and useful method and device for lining a shaft which extends through a water bearing formation.

Methods of sinking shafts through water-bearing formations are known. Frequently the freezing method is employed in which, at the location where the shaft is to be sunk, heat is removed from the water-bearing region up to the freezing temperature for water. A frozen jacket is thereby produced whose axis coincides with that of the shaft to be provided. Within this jacket, the shaft can be excavated under the protection of the frozen wall as in a dry formation, and made watertight. The freezing method, however, is relative expensive in labor and installation, since freezing tubes must be driven at the perimeter of the future shaft through the aquiferous layers down into an underlying impermeable formation. In addition, fall pipes must be suspended in the freezing tubes and continuously supplied with a low-temperature fluid as the cooling agent. This requires the installation of a refrigerating machine on the surface.

A shaft boring method is also known in which a bore hole of larger diameter and without lining is driven through the aquifer zone and an excess pressure relative to the hydrostatic pressure of the surrounding water is produced within the bore. This excess pressure is produced by a column of liquid reaching up to the bore mouth, for example a column of slushed fluid, such as clay mud-laden flush water. The pressure of the fluid column retains the surrounding water. In this prior art method, the lining structure is assembled on the surface, above the finish-bored shaft hole, and then immersed into the hole which is filled with the mud-laden fluid. The lining, as a rule, is a double-walled steel tube assembled of annular tube lengths filled with concrete and provided with a false bottom. The steel tube plunges into the clay-laden fluid under its own weight, with the inner space of the tube being filled with water as ballast. The clay-laden fluid is thereby displaced upwardly. Upon reaching the final depth, the steel tube is plumb-lined to the center of the bore hole and the annular space between the tube and the wall of the hole is filled with concrete. Then, the water ballast is pumped out, the false bottom is removed and boring may continue.

The shaft boring method is preferred to the freezing method for reasons of economy, because boring is much faster than conventional digging and, in addition, the refrigerating equipment is omitted. Only, the plunging of the lining which is assembled on the surface is very problematic. That is, the double-walled steel tube filled with concrete is extremely heavy and the weight is yet considerably increased by the water ballast. Therefore, it frequently happens that the boring derrick set up over the shaft mouth is not sufficiently dimensioned for the plunging operation and may collapse. This endangers the crew and may seriously damage the bore, up to its complete destruction. But even without such mishaps, the plumb-lining alone, which is needed for centering of a lowered lining, is extremely complicated and difficult, because of the excessive weight to be handled. The invention design eliminates these drawbacks.

SUMMARY OF THE INVENTION

The present invention is directed to a method which provides the placement of a lining in bored shafts, especially a watertight lining in shafts to be bored through a water-bearing formation, in a manner which is particularly economical and safe.

Accordingly an object of the invention is to provide a method of lining a bore shaft extending through an aquiferous formation and having a shoulder near a lower boundary of the formation comprising, lowering a base ring and plurality of guide and alignment columns into the bore shaft, the base ring being seated on the bore shoulder, centering the base ring and the columns in the bore, and sequentially lowering and guiding one lining ring at a time on the columns into the bore and onto the base ring or a previously lowered lining ring to form a sealing joint therewith.

The invention utilizes the economical advantages of the shaft boring method while, at the same time, the lining work can substantially be simplified and made safer as compared to the usual method of immersing a lining which is assembled on the surface. This is so since the assemblage and following immersion of the complete lining structure is omitted. Rather, the lining is put in place by lowering the individual lining rings into the bore hole zone extending in the range of the water-bearing layers, between the upper and the lower boundary of the water horizon. Due to the reduction in weight that must be handled neither lowering of a base ring of the lining nor its centering and aligning by means of guide an alignment columns poses any problems.

The derrick used for boring the hole is well suitable for such an operation, without running the risk of collapse. The movements of the base ring and the guide columns during the alignment and centering operation can be controlled in a much simpler way and faster than those of a completely assembled lining. After the operation of aligning and centering the base ring and the guide and alignment columns, the lining rings can easily be threaded on the columns and lowered to the base ring and on one another in centered aligned position so that a lining tube plumb-lined to the center of the bore hole forms almost automatically. During this operation, the excess pressure in the bore hole needed for retaining the surrounding water is produced in a conventional way by establishing a column of slushed fluid, especially flush water or clay-laden water, reaching up to the bore hole mouth.

Surprisingly, the joints between the individual lining rings and the base ring become watertight so that a lining tube which is impermeable to water is obtained as desired. This is probably due to the fact that with the flush water filling, the lining tube assembled in the inventive way is loaded substantially only by its own weight and that the water from the rock formation does not penetrate to the tube. Particularly, if clay-laden water is used, the sealing effect is improved by the deposited clay.

According to another object of the invention, the rings may be lowered using a boring column, originally used for the boring bit. However, the rings may also be lowered by means of chains, or ropes and a winch supported on the boring derrick. With the objective of improving the sealing effect, the invention teaches that a sealing strip can be used between rings. A preferred modification of the invention teaches that the columns are subjected to a tensile stress. This securely prevents the guide and alignment columns from bending or buckling under their own weight, so that the centering and alignment attained by means of the base ring is securely preserved and a satisfactory lowering and seating of subsequent lining rings as well as sealing effect of the tongue and groove connections are insured.

A development of the invention provides that the space between the lining and bore is filled with water and/or pressure resistant material. Suitable conventional fillers are cement grout, lean concrete, bitumen, or asphalt. While cement grout, lean concrete and asphalt will best be suitable for a lining fixed to the bore hole wall, bitumen will be used for a drop-wall lining.

Upon finishing the waterproof lining, the guide and alignment columns may be removed. Then the shaft may further be sunk by boring or conventional digging and secured with a lining which is permeable to water.

The invention is further directed to a device for carrying out the claimed method, which is particularly simple and easily operable. Thus a further object of the invention is to provide a device for lining a bore shaft comprising, a plurality of guide and alignment columns adapted to extend into a bore shaft, a base ring connected at a lower end of the columns, the columns being evenly distributed around the circumference of the base ring, and clamping means connected near the top of the columns at a mouth of the bore shaft. Another object is to provide such a device which includes a plurality of lining rings guided and aligned on the columns to produce a stack of lining rings above the base ring each engaged with each other at a sealing joint formed on opposite edges of the lining rings and the top edge of the base ring. The device may also utilize guide pipes to form the guide and alignment columns.

The design of the guide and alignment columns as guide pipes is advisable not only for weight-sealing reasons, but it also may permit using the pipes for filling the space between the lining and the bore hole wall with a filler, without or under pressure. The detachable connections between the guide pipes and the base ring is advisable to be able to withdraw the guide and alignment columns after finishing the waterproof lining. The clamping and tensioning devices at the bore hole mouth not only keep the guide pipes in centered and aligned position, but also provide compensation for their own weight so that the pipes neither bend nor buckle. The guide pipes may be designed for screwing into threaded sleeves embedded at the circumference of the base ring which, preferably, is a concrete ring, as are the lining rings.

In principle, however, any detachable securing of the guide pipes to the base ring may be provided. Each lining ring according to another object of the invention is provided with recesses that are aligned with the guide pipes, with each recess and aligned guide pipe having a cover strip connected to the lining ring acting as a guide bushing for sidably engaging the guide pipe. With this design, the lining rings can easily be threaded onto the guide pipes and lowered. On their abutting surfaces, both the base ring and the lining rings are formed with mating circular tongue and groove portions, so that a considerable sealing effect is obtained even without inserting waterproofing strips or filters into the joints, especially if flush water with a colloidal suspension is used. In addition, preferably, the lining rings may be designed for being engaged from their inside by a retaining and setting mechanism which can be attached to the boring column and is equipped with expanding jaws for example. Advantageously, sections of columns can be threaded together, so that even with a string of guide pipes, an aligned lowering of the lining rings is insured.

The principle advantage of the inventive method is that it makes possible the provision of bored shafts with a lining, more particularly a watertight lining in aquiferous zones, in a very economical and safe way. The inventive method eliminates the complications otherwise encountered with the immersing of a lining which is completely assembled on the surface. The assembly is now effected within the bore hole and the lining is still impermeable to water.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiment of the invention is illustrated.

BRIEF DESCRIPTION OF THE DRAWINGS

In the Drawings:

FIG. 2 is a view similar to FIG. 1 showing the lowered base ring and the guide and alignment columns of the invention;

FIG. 2*a* is a detail view of FIG. 2 showing assembly of a column according to the invention;

FIG. 5 is a cross-sectional view taken along the line 5—5 of FIG. 2;

FIG. 5*a* is a detail view of FIG. 5 showing engagement between the column and a lower base ring of the invention.

DESCRIPTION OF THE PREFERRED EMBODIMENT

Figure 4:
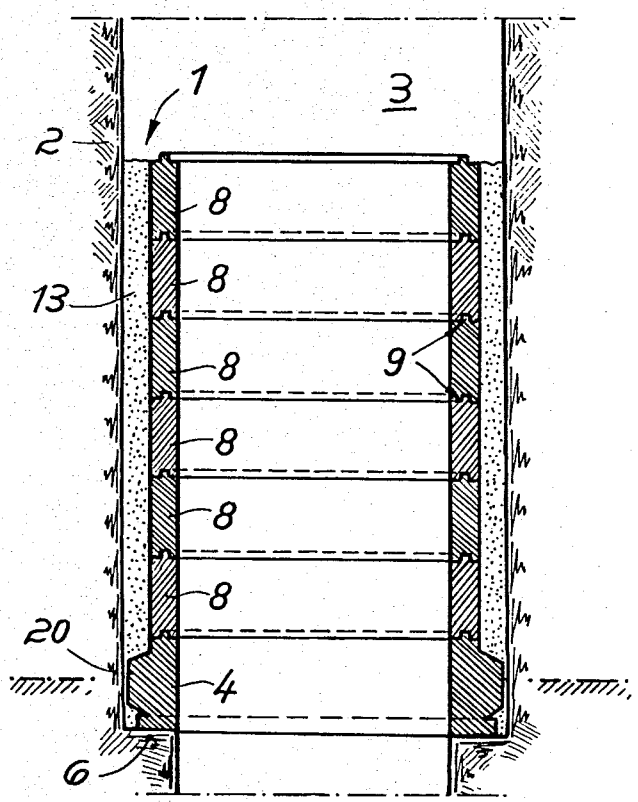
FIG. 4 is a view similar to FIG. 2 showing the finished waterproof lining of the invention.
Figure 1:
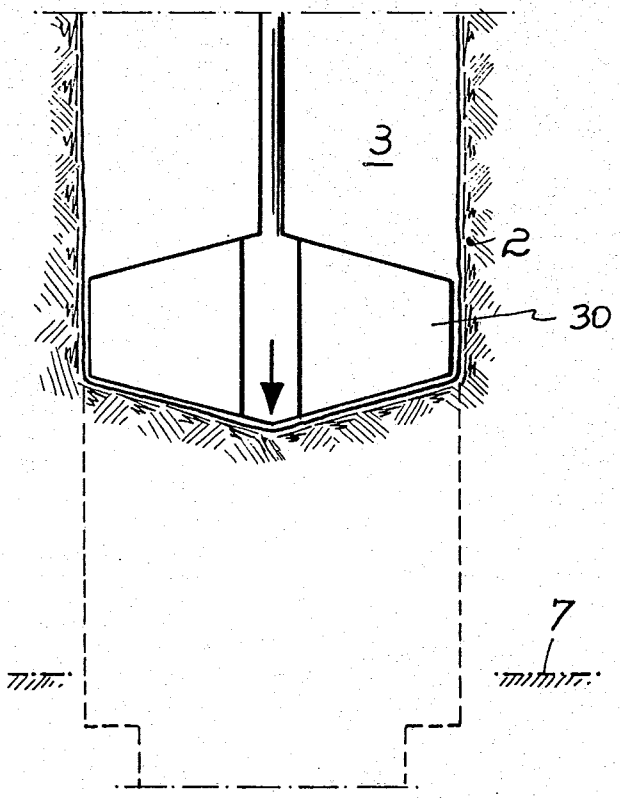
FIG. 1 is a diagrammatical sectional view of a shaft hole being bored into a water bearing formation.

The figures illustrate a method of installing a waterproof lining generally designated 1, in a shaft hole bored, using a known bit 30, through a water bearing formation 2 in which, after boring the hole 3, the lining is lowered to a dry bedrock layer, whereupon the sinking of the shaft may be continued.

In accordance with the invention, the operation comprises initially lowering a base ring 4 shown in FIG. 2, by means of guide and alignment columns 5 into the bore hole 3 and seating it on a shoulder 6 provided in the bored hole beneath the lower boundary 7 of the aquiferous horizon. Base ring 4 as well as the guide and alignment columns 5 are then centered and aligned, and lining rings 8 are lowered on the guide and alignment columns 5 one after the other to form a lining tube above base ring 4. The individual rings 8 are engaged with each other and with base ring 4 through watertight tongue and groove connections 9 (see FIG. 3). The rings are threaded on the guide and alignment columns 5 and lowered by means of a boring column 10 which was anyway provided for initially boring the shaft hole 3. It is also possible however to lower the rings 8, 4 by means of a chain or rope winch supported by a partly shown derrick 11.

Figure 3:
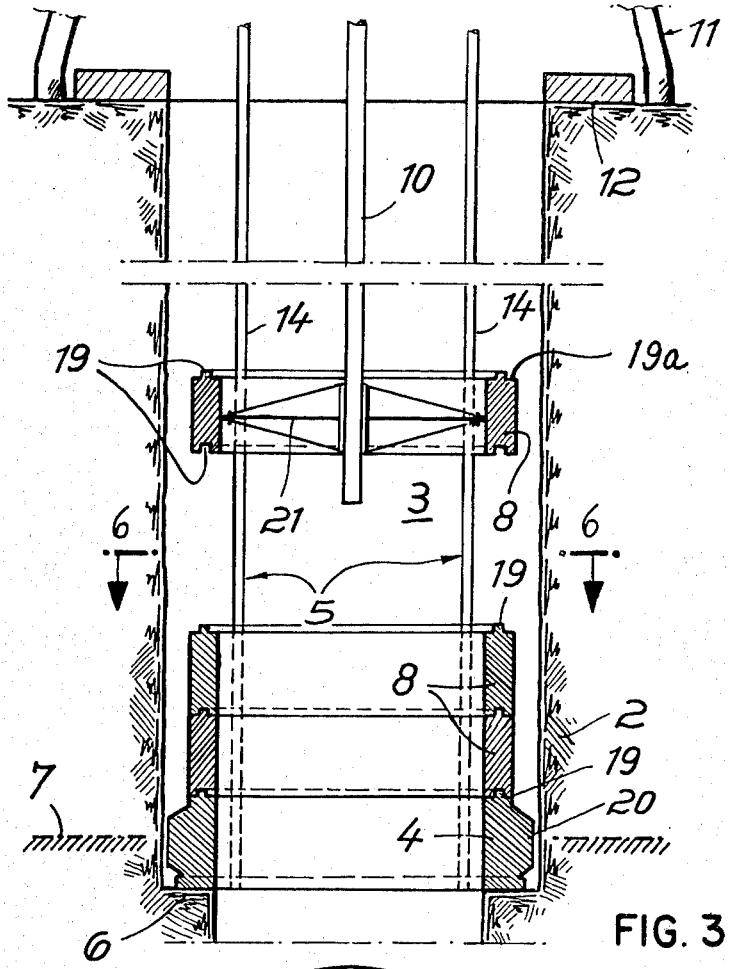
FIG. 3 is a view similar to FIG. 2 showing the lowering of lining rings into the bore.

To improve water-tight sealing, a filler or sealing strips 19*a* in FIG. 3, are put into the tongue and groove joints 9 formulated between lining rings 8 and the lowermost ring 8 and base ring 4.

At the level of the bore mouth 12 shown in FIG. 2 guide and alignment columns 5 are fixed in clamps to subject them to a tensional stress determined by their own weight. The space between the formed lining tube and the bore hole wall may be filled with a waterproof and/or pressure-resistant filler 13 as shown in FIG. 4, supplied through guide and alignment columns 5 by gravity or under additional pressure. The columns can be provided with side openings at points along their length for this purpose. After finishing the watertight lining 1, the guide and alignment columns 5 are withdrawn.

Figure 6:
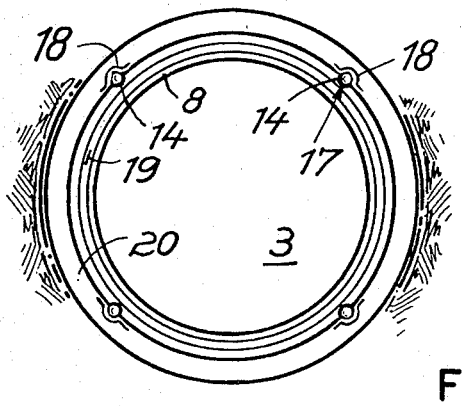
FIG. 6 is a cross-sectional view taken along the line 6—6 of FIG. 3.

The guide and alignment columns 5 comprise 3 or more guide pipes 14 which are uniformly arranged over the circumference of base ring 4 and detachably connected thereto by their lower ends while their upper ends may be clamped in tensional stress-producing clamping mechanisms 15 provided at the surface. The columns are thereby in effect susended from clamps 15. In principle, guide rods may also be provided instead of guide pipes 14. Guide pipes 14 can be screwed into threaded sleeves which are embedded at the circumference of base ring 4. See the details of FIG. 5*a*. Both base ring 4 and lining rings 8 are of concrete. As seen in FIG. 6, lining rings 8 are provided on their circumference, with axially extending recesses 17 or grooves aligned with guide pipes 14 and forming, along with cover strip skirting pipes 18, guide bushings for rings 8 which slide on pipes 14. On their abutting faces, base ring 4 and lining rings 8 are formed with mating circular tongue and groove connections 19. In addition, base ring 4 is formed on its circumference with a centering ring 20 or other centering elements for centering base ring 4 in bore 3. A retaining and setting mechanism 21 connectable to boring column 10 is provided which is equipped to engage lining rings 8 by means of expanding clamping jaws, for example. That is, mechanism 21 can be mounted to column 10 and expanded inside a ring 8 to hold the ring by friction so that it can be lowered into the bore 3.

Referring to FIG. 2*a*, while preserving the outer diameter of guide pipes 14 they are provided on one end with a threaded neck 22 and on their other end with a screw socket 23 so that they may be assembled to a constant-diameter string of any length as needed.

While a specific embodiment of the invention has been shown and described in detail to illustrate the application of the principles of the invention it will be understood that the invention may be embodied otherwise without departing from such principles.

What is claimed is:

1. A method of lining a bore shaft extending through an aquiferous formation comprising:

boring the bore shaft through the aquiferous formation to form a shoulder below a lower boundary of the aquiferous formation;

detachably connecting a plurality of guide and alignment columns to a base ring;

lowering the base ring and plurality of columns into the bore shaft to seat the base ring on the bore shoulder;

centering the base ring and columns in the bore shaft;

subsequently lowering and guiding one lining ring at a time on the column into the bore shaft and onto one of the base rings and a previously-lowered lining ring to form a sealing joint therewith, the base ring and lining rings stacked to form a lining tube in the bore shaft; and forming each of the lining rings and base ring to have water-tight tongue and groove sealing joints therebetween.

2. A method of lining a bore shaft according to claim 1, wherein the bore shaft is filled with slushed fluid during the lowering of the base ring and lining rings to form the lining tube.

3. A method of lining a bore shaft according to claim 2, wherein the slushed fluid comprises one of flush water and clay-laden water whereby a water-tight characteristic of the sealing joints between the base and lining rings is increased.

4. A method of lining a bore shaft according to claim 1 wherein each of said columns includes a lower threaded end, said base rings including a plurality of threaded openings, including detachably connecting said plurality of columns by screwing each of said columns into a respective one of said threaded openings.

5. A method of lining a bore shaft according to claim 1, including lowering said lining rings as they are guided and aligned on said column using a boring column engaged with each lining ring as it is lowered.

6. A method of lining a bore shaft according to claim 1, including positioning a sealing joint member between each base and lining member and the sealing joint therebetween.

7. A method of lining a bore shaft according to claim 1, including supporting each of said plurality of guide and alignment columns near an open upper end of the bore shaft to subject each column to tensile stress corresponding to the weight of each column.

8. A method of lining a bore shaft according to claim 1, including filling a space between the lining tube and the bore shaft with filler material.

9. A method of lining a bore shaft according to claim 8, including supplying the filler material through at least one of the plurality of columns.

10. A method of lining a bore shaft according to claim 1, including detaching each of said columns from said base ring after all of said lining rings have been sequentially lowered into the bore shaft, and withdrawing the columns from the bore shaft.

* * * * *